United States Patent [19]

Wada et al.

[11] 4,115,023

[45] Sep. 19, 1978

[54] PAVING MATERIAL AGITATION APPARATUS FOR USE IN WATER CHANNEL FORMING MACHINE

[75] Inventors: Mitsuyoshi Wada, Yamato-Takada; Hideyuki Shimada; Koji Ohta, both of Hirakata, all of Japan

[73] Assignee: Kabushiki Kaisha Komatsu Seisakusho, Tokyo, Japan

[21] Appl. No.: 876,147

[22] Filed: Feb. 8, 1978

[51] Int. Cl.[2] ..... E01C 11/28

[52] U.S. Cl. ..... 404/98; 298/27

[58] Field of Search ..... 404/98, 96, 108, 110, 404/106; 298/24, 27

[56] References Cited

U.S. PATENT DOCUMENTS

| | | | |
|---|---|---|---|
| 2,063,400 | 12/1936 | Robb | 404/108 X |
| 2,311,726 | 2/1943 | Blue | 404/110 X |
| 2,818,790 | 1/1958 | Canfield | 404/98 |
| 3,034,410 | 5/1962 | Ross | 404/108 |
| 3,137,220 | 6/1964 | Smith | 404/98 |
| 3,161,117 | 12/1964 | Supject | 404/98 |
| 3,254,578 | 6/1966 | Bessette | 404/98 |
| 3,396,644 | 8/1968 | Banks | 404/108 X |
| 3,909,146 | 9/1975 | Hoffman | 404/110 |

*Primary Examiner*—Nile C. Byers

*Attorney, Agent, or Firm*—Armstrong, Nikaido, Marmelstein & Kubovcik

[57] ABSTRACT

A paving material agitation apparatus for use in water channel forming machines comprising a hopper adapted to accommodate therein paving materials to be laid, a plurality of first screws spaced apart with each other in said hopper, a plurality of rotary drives each being secured to one end of said first screws, respectively, an agitation impeller rotatably engaged with one of said first screws, a rotary shaft rotatably supported by said hopper, said agitation impeller being fixedly secured to said rotary shaft so as to be rotated therewith, and a second screw formed on said rotary shaft.

4 Claims, 3 Drawing Figures

PAVING MATERIAL AGITATION APPARATUS FOR USE IN WATER CHANNEL FORMING MACHINE

BACKGROUND OF THE INVENTION

This invention relates to an improvement of hopper means for use in water channel forming machine for laying a paving material prepared, for example, by mixing asphalt and sand to construct a water channel continuously.

The water channel forming machine of the kind specified includes hopper means having screws mounted on the bottom thereof, and is arranged to send out continuously the paving material accommodated in the hopper means by the action of the screws. However, such conventional water channel forming machine is disadvantageous in that the high viscosity of the paving material causes formation of cavities in vicinity of the screws which sometimes renders sending-out of the paving material by the screws impossible.

SUMMARY OF THE INVENTION

It is therefore an object of the present invention to provide a paving material agitation apparatus for use in water channel forming machines wherein paving materials to be laid are fully agitated so as to avoid formation of cavities therein.

In accordance with an aspect of the present invention, there is provided a paving material agitation apparatus for use in water channel forming machines which comprises hopper means adapted to accommodate therein paving materials to be laid, and a plurality of first screw means spaced apart with each other, each of said first screw means being extended in a direction parallel to a direction of the water channel forming machine to be advanced. Each of said first screw means having mounted thereon at one end thereof a rotary drive means which functions to rotate the first screw means. An agitation impeller is rotatably engaged with one of said first screw means, and a rotary shaft is rotatably supported by said hopper means, said agitation impeller being fixedly secured to said rotary shaft so as to be rotated therewith.

Integrally mounted on said rotary shaft is second screw means comprising two screws, both being arranged symmetrically with respect to the agitation impeller so that the paving material in the central part can be guided toward side walls of said hopper means when they are rotated.

The above and other objects, features and advantages of the present invention will be readily apparent from the following description taken in conjunction with the accompanying drawings.

DESCRIPTION OF THE PREFERRED EMBODIMENTS

The present invention will now be described below by way of an embodiment with reference to the accompanying drawings.

Figure 1:
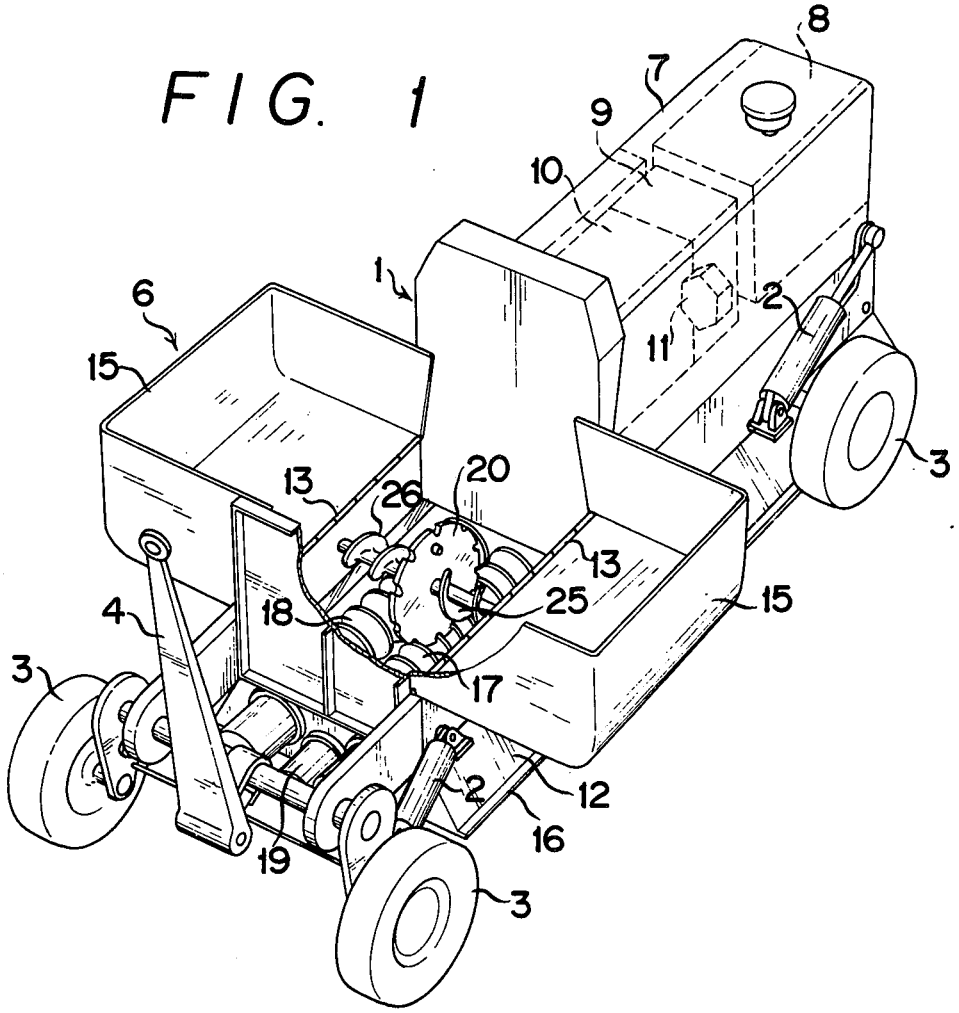
FIG. 1 is a schematic illustration of a water channel forming vehicle equipped with a paving material agitation apparatus according to the present invention.

Referring to FIG. 1, reference numeral 1 denotes a water channel forming vehicle or machine body provided with wheels 3 adapted to be moved up and down freely by means of lift cylinders 2. Mounted on the front part of the machine body 1 is an axially pivoting traction member 4 adapted to be dragged by another vehicle for example, a tractor or the like.

Mounted in the front part of the above-mentioned vehicle body 1 is a hopper means 6 for accommodating molding material or paving material 5 prepared by mixing, for example, asphalt and sand. Mounted in the rear part of the vehicle body 1 is an engine compartment 7 which accommodates therein an engine 8, a fuel tank 9, a hydraulic fluid tank 10 and a hydraulic pump 11 etc.

The above-mentioned hopper means 6 comprises a main hopper housing 12 and auxiliary hopper housing 15, 15 which are pivotally mounted thereon about horizontal axes 13, 13 and which can be tilted by the action of adjusting hydraulic cylinders 14, 14. When the water channel forming machine of the present invention is rendered operative, the lift cylinders 2 are actuated to raise the wheels 3 thereby allowing lower ends 16 of the main hopper housing 12 to be brought into contact with the bottom surface of the water channel.

Figure 2:
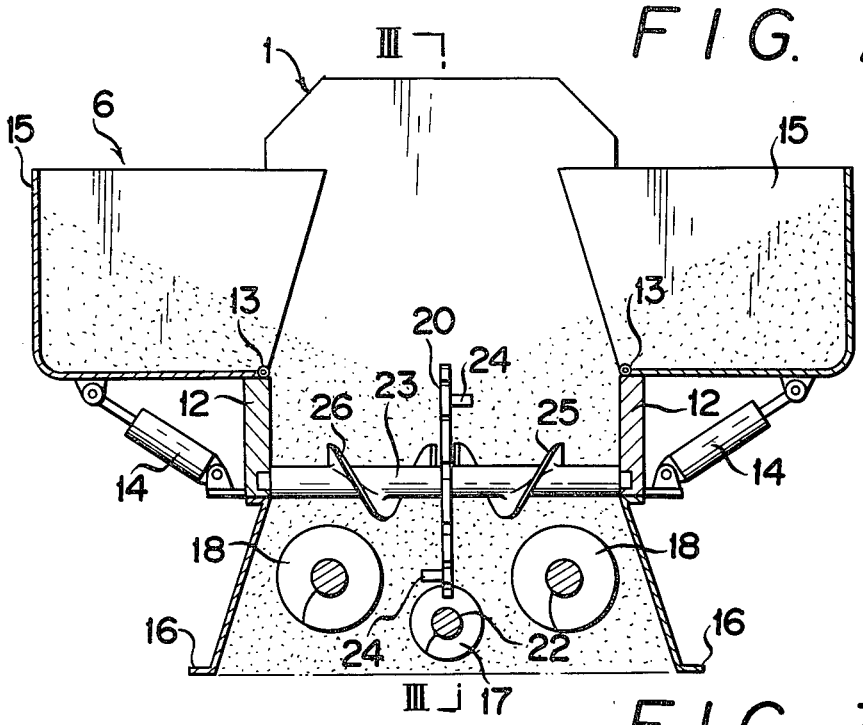
FIG. 2 is a cross-sectional view of the hopper means.
Figure 3:
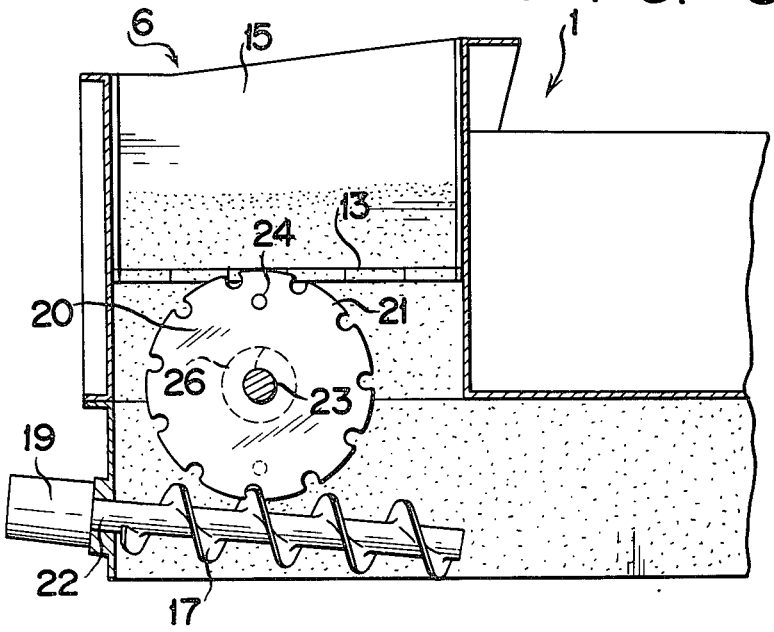
FIG. 3 is a view taken along the line III—III in FIG. 2.

Referring to FIG. 2, screws 17 and 18 are installed in the central part and the sides of the bottom of the main hopper housing 12. These screws 17 and 18 are arranged to be driven or rotated by rotary drive means 19 such as hydraulic motors mounted on one side of the main hopper housing 12. Out of the screws 17 and 18, for example, the screw 17 located in the central part thereof is engaged by an agitator impeller 20. The agitator impeller 20 comprises a disk-shaped member having teeth 21 formed in the periphery thereof and adapted to engage with the screw 17. The agitator impeller 20 is fixedly secured to the central part of a rotary shaft 23 which is transversely supported above the screw 17 and at right angles to a screw shaft 22. The agitator impeller 20 has a plurality of projections 24 extending from both side surfaces thereof. Further, both ends of the above-mentioned rotary shaft 23 are rotatably carried by the main hopper housing 12. The rotary shaft 23 has agitator screws 25 and 26 fixedly secured thereto. The screws 25 and 26 are arranged symmetrically with respect to the agitation impeller 20 so that the paving material in the central part can be guided above the side screws 18 and 18 when they are rotated.

Thus, when the screws 17 and 18 are rotated so as to send out the paving material 5 accommodated within the auxiliary hopper housing 15 and the main hopper housing 12, the agitator impeller 20 engaged with the central screw 17 is rotated so that the paving material 5 located above the screw 17 can be agitated by the projections 24 mounted on both sides of the agitator impeller 20. At the same time, the rotary shaft 23 having the agitator impeller 20 fixedly secured thereto is rotated so as to permit the agitator screws 25 and 26 mounted on the rotary shaft 23 to agitate and cut through the paving material 5 above the screws 17 and 18. Therefore, during the rotation of the screws 17 and 18, no cavity is formed in the periphery of the screws 17 and 18, and so the paving material 5 within the main hopper housing 12 can be sent out smoothly and continuously.

As mentioned in detial hereinabove, according to the present invention, arrangement is made such that the paving material located above the screws can be agitated and cut through by the agitator impeller adapted to be rotated by the central screw mounted on the bottom of the main hopper housing and also by the agitator screws projecting from the rotary shaft of the agitator impeller so that there is no risk of occurrence of solidification of the paving material above the screws and generation of cavities in the periphery of the screws.

Such arrangement can eliminate the risk of the paving material becoming impossible to be sent out or discharged and is also economical from the viewpoint of requiring no separate power source for rotating the agitator impeller. Further, upon formation of cavities in the periphery of the screws due to any reason, the screws are idly rotated at higher speed of rotation; however, as a result, the number of rotations of the agitator impeller is increased to improve the agitation effect thereof so as to ensure that the tendency of formation of cavities in the periphery of the screws is completely eliminated.

It is to be understood that the foregoing description is merely illustrative of the preferred embodiment of the present invention and that the scope of the invention is not to be limited thereto, but is to be determined by the proper scope and fair meanings of the appended claims.

What is claimed is:

1. A paving material agitation apparatus for use in water channel forming machines comprising hopper means adapted to accommodate therein paving materials to be laid, a plurality of first screw means spaced apart with each other, each of said screw means being extended in a direction parallel to a direction of the water channel forming machine to be advanced, a plurality of rotary drive means each being secured to one end of said first screw means, respectively, agitation impeller means rotatably engaged with one of said first screw means, rotary shaft means rotatably supported by said hopper means, said agitation impeller means being fixedly secured to said rotary shaft means so as to be rotated therewith, and second screw means formed on said rotary shaft means.

2. A paving material agitation apparatus as defined in claim 1 wherein said second screw means is devided into two screws, both screws being arranged symmetrically with respect to said agitation impeller means.

3. A paving material agitation apparatus as defined in claim 1 wherein said agitation impeller means has a plurality of teeth formed circumferentially therearound, each tooth being equally spaced and defining recesses therebetween, the distance between the adjacent recesses being equal to the pitch of said first screw means.

4. A paving material agitation apparatus as defined in claim 1 wherein said hopper means comprises a main hopper and a pair of auxiliary hoppers pivotally mounted on said main hopper.

* * * * *

UNITED STATES PATENT AND TRADEMARK OFFICE

CERTIFICATE OF CORRECTION

PATENT NO. : 4,115,023

DATED : September 19, 1978

INVENTOR(S) : Mitsuyoshi WADA; Hideyuki SHIMADA: Koji OHTA

It is certified that error appears in the above-identified patent and that said Letters Patent are hereby corrected as shown below:

On the cover page, between items [22] and [51] insert:

--[30] Foreign Application Priority Data

February 8, 1977 Japan . . . . . 52-13173

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*